United States Patent [19]

Fischer

[11] Patent Number: 4,554,779

[45] Date of Patent: Nov. 26, 1985

[54] MACHINE FOR STRAPPING PACKAGES AND THE LIKE

[75] Inventor: Charles Fischer, Wohlen, Switzerland

[73] Assignee: Strapex AG, Wohlen, Switzerland

[21] Appl. No.: 622,290

[22] Filed: Jun. 19, 1984

[30] Foreign Application Priority Data

Jun. 21, 1983 [CH] Switzerland ..... 3386/83

[51] Int. Cl.[4] ..... B65B 13/10

[52] U.S. Cl. ..... 53/589; 53/588; 100/27

[58] Field of Search ..... 53/582, 588, 589; 100/27, 33 PB

[56] References Cited

U.S. PATENT DOCUMENTS

| | | | |
|---|---|---|---|
| 1,235,312 | 7/1917 | Hadert | 53/588 |
| 2,262,232 | 11/1941 | Harvey | 100/27 |
| 3,126,686 | 3/1964 | Kobylanski et al. . | |
| 3,771,435 | 11/1973 | Vascotto et al. . | |
| 4,020,756 | 5/1977 | Weiss . | |
| 4,137,788 | 2/1979 | Flacher . | |
| 4,153,499 | 5/1979 | Annis | 100/33 PB |

FOREIGN PATENT DOCUMENTS

| | | |
|---|---|---|
| 913637 | 6/1954 | Fed. Rep. of Germany . |
| 2518211 | 11/1976 | Fed. Rep. of Germany . |
| 1531593 | 5/1968 | France . |

*Primary Examiner*—John Sipos

*Attorney, Agent, or Firm*—Werner W. Kleeman

[57] ABSTRACT

A continuously driven endless belt trains about deflection rolls within a frame which surrounds a tunnel for the reception of the package which is to be strapped or tied with a ligature in the form of a plastic strap or band. Connectable with the revolting belt is a carriage which guides the plastic strap or band withdrawn from a supply roll along a prescribed path of travel about the tunnel. After each revolving motion of the plastic strapping band the carriage is again uncoupled from the endless belt at the region of a strap wrapping and connection unit, in order to transfer the starting portion of the strapping band which has been guided around the package to a strap or band closure device and, following the tensioning and cutting of such band, to engage a new starting band portion to accomplish the next strapping of the band about a new package. With such construction of the package strapping machine it is only necessary to again accelerate and brake the carriage which possesses low mass during each operating cycle of the machine, so that there is no need for any control device for the belt drive and there is possible an extremely high acceleration of the carriage for carrying the strapping band about the package.

15 Claims, 16 Drawing Figures

MACHINE FOR STRAPPING PACKAGES AND THE LIKE

BACKGROUND OF THE INVENTION

The present invention relates to a new and improved construction of a machine for the strapping or wrapping of various types of articles or packages with a ligature, typically a wrapping or strapping band or strap.

Generally speaking, the package strapping machine of the present development is of the type wherein the strapping band has the starting portion thereof engaged by a carriage or traveler which is supported by an endless band or belt or equivalent carriage drive element. The starting band portion is guided by the moveable carriage about a prescribed band guide or travel path along a package strapping tunnel which receives the package or article which is to be tied with the strapping band, so that there can be formed a band strapping loop around the package from the thus guided strapping band. There are also provided holder means protruding into and moveable out of the plane containing the band strapping loop in order to retain such band strapping loop and to release such so that it engages about the package. There is also provided an intermediate band storage having a reverse or take-up storage capacity for taking-up slack of the strapping band, this intermediate storage being arranged between a band supply roll and the travel path of the strapping band. A clamping and connection device serves for fixedly retaining and connecting the ends of the strapping band which encircles the package.

Such type of package strapping machine which contains a band strapping tunnel and operates automatically in response to push-button actuation serves for the continuous wrapping or tying of successively infed packages or articles, which, for instance, can be constituted by the most various type of packages or objects which are to be wrapped with a wrapping or strapping band or the like or tied into package bundles. As the ligature or strapping band there is preferably employed a plastic band or strap which is paid-off a band supply roll and tightened about the package, cut and welded or heat-sealed at its ends so that such band ends are firmly interconnected. The ligature can, however, also possess a different cross-sectional configuration than that of a band or tape or a cord. The article or package strapping machine is particularly contemplated for use with ligatures or strapping bands or the like which, by virtue of their insufficient stiffness or rigidity, must be pulled or drawn about the package to be strapped or tied instead of being pushed thereabout.

A strapping machine of this type which is known from the German Patent Publication No. 2,518,211, possesses a program circuit for controlling the carriage or traveler, designated as an entrainment clamp or gripper, for the ligature. The stopping of the carriage as well as the operations required for transfer of the starting portion of the ligature trained about the article or package and for seizing the new ligature starting portion is controlled by means of a circuit. With this arrangement, it is necessary to stop and again accelerate the belt carrying the carriage in conjunction with the carriage following each orbit or revolving motion of the carriage. However, each acceleration requires an increased amount of time the greater the mass which must be accelerated. Furthermore, during each acceleration the parts which are accelerated are subjected to increased wear. In order to be able to rationally employ such strapping machine the working or operating cycle must be as brief as possible.

A further drawback of the heretofore known strapping machine is the return or band slack take-up force which is limited by the storage containing the return storage capacity during tensioning of the ligature about the package. This is governed by the fact that the band storage comprises a through-pass storage arranged between the supply roll and the band carry region, wherein the return or take-up force of such storage must be smaller than the tension force of the carriage.

Furthermore, there is known from the German Pat. No. 913,637 a strapping machine which, however, does not belong to the species of strapping machines classified as tunnel machines. Here, the articles or packages which are to be strapped or tied cannot be successively pushed through the machine. Consequently, it is necessary to laterally withdraw each strapped package towards that side where such package has been infed to the machine, whereby there is rendered more difficult a rational handling of the packages. This prior art machine possesses a chain which is continuously driven and equipped with projections serving as entrainment members. A dolly or carriage guided by rollers upon a guide track can be coupled with and decoupled from this chain. The dolly or carriage draws, by means of an eyelet-like device, a wire serving as the ligature about the previously inserted package. Owing to the manner of infeeding the ligature, this prior art machine is not suitable for the processing of bands. The circulating chain and the dolly or carriage traveling upon the rollers generate a great deal of noise. The entrainment members arranged at the chain require a special design of the chain which is subjected to wear and such not only generate additional noise upon coupling the dolly or carriage, but also there is present a jerk-like loading of all of the moveable parts. This prior art strapping machine also is not capable of accomplishing a preparatory loop formation, so that the band strapping or tying operation only can be accomplished after the insertion and retension of the package or article to be wrapped. Consequently, with this known machine there are not possible any appreciable short operating or work cycles.

SUMMARY OF THE INVENTION

Therefore, with the foregoing in mind it is a primary object of the present invention to provide a new and improved construction of an article strapping machine which is not afflicted with the aforementioned shortcomings and drawbacks of the prior art constructions.

Another and more specific object of the present invention relates to a new and improved construction of an article or package strapping machine of the previously mentioned type, wherein for the purpose of obtaining a high cycle velocity during each working or operating cycle of the machine only very small masses need be accelerated.

A further important object of the present invention aims at the provision of a new and improved construction or article or package strapping machine wherein the tension force, during tensioning of the article or package strapping ligature, is greater than the tension force of the carriage or traveler.

Now in order to implement these and still further objects of the invention, which will become more readily apparent as the description proceeds, the article or package strapping machine of the present development is manifested by the features that the carriage can be disconnected from the continuously revolving or orbiting belt or band and possesses for this purpose a releasable coupling device. This coupling device can be actuated by an actuation device arranged at the region of the clamping and closure device. Furthermore, there is provided a positioning device for positioning the uncoupled carriage in relation to the clamping and closure device.

With the inventive solution of article strapping machine it is only necessary to accelerate and again brake the carriage which possesses low mass, whereas the belt or the like together with its drive can continue to run. It is also possible to temporarily interrupt the energy inputted to the drive prior to stopping of the carriage, in order to obtain, by virtue of the thus initiated running-down of the carriage drive, a more gentle braking of the uncoupled carriage. Although the brief interruption of the drive energy hardly leads to a discernible velocity reduction of the belt, there can be thereby obtained a reduction in the noise and a still further reduction in the wear of the parts which are effective for the purpose of braking the carriage.

However, with the renewed start of the carriage the belt again possesses its full velocity. Since the coupling device according to the invention is exclusively arranged at the carriage or traveler, there are not required at the belt any means, such as for instance entrainment members, so that there can be advantageously employed for this purpose conventional, commercially available belts or the like. No guide arrangement is required along the guide track for the carriage which is freely supported by the belt.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
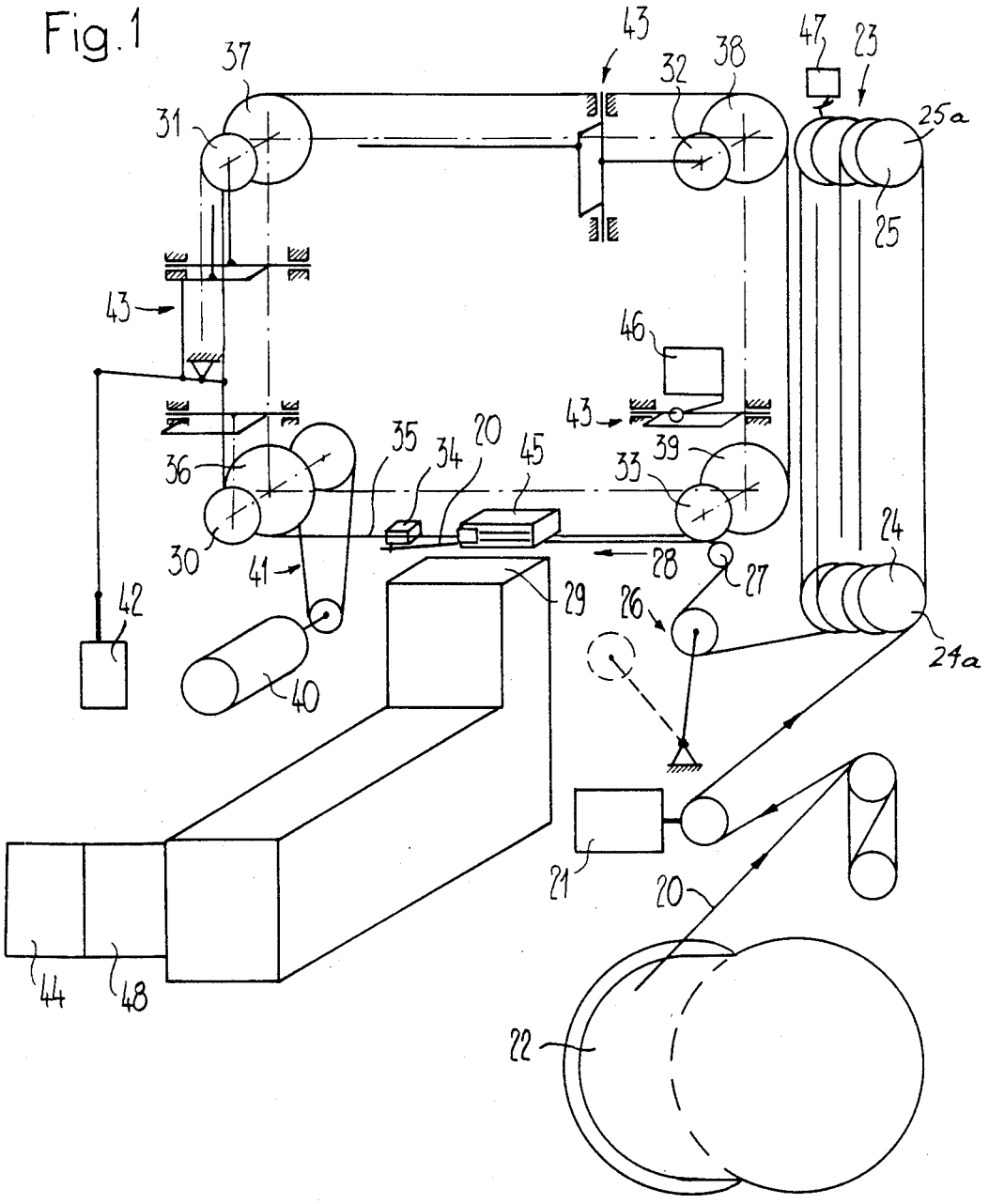
FIG. 1 is a principle schematic illustration of a strapping machine for the strapping or tying of articles or packages with a ligature.

Describing now the drawings, it is to be understood that only enough of the construction of the article or package binding or strapping machine has been shown as needed for those skilled in the art to readily understand the underlying principles and concepts of the present development, while simplifying the showing of the drawings. Turning attention now to FIG. 1, the package binding or strapping machine shown therein has the individual structural components or groups of components, serving for the binding or strapping of the packages or the like, depicted in a functional correlation to one another. The ligature, here shown in the form of a strapping band or strap 20, intended to bind or strap a package or article which is to be equipped with such strapping band 20, is withdrawn by means of a band infeed drive 21 from a band supply roll or roller 22. The withdrawn strapping band 20 is infed to a band storage or storage means 23 which possesses two mutually oppositely situated sets of rolls or pulleys 24 and 25 which are preloaded by spring force in opposite directions. Each of both rolls or roller sets 24 and 25 possesses a plurality of rolls or rollers **24*a* and 25*a* which are arranged to be freely rotatable upon a respective shaft or axle. The rolls 24*a* and 25*a* of both roll sets 24 and 25, respectively, are alternately entrained by the strapping band 20. After the strapping band 20 has passed all of the rolls 24*a*, 25*a* of the band storage 23, it is infed by means of a force tensioning device 26 and a deflection roll 27 to a band travel or orbiting path 28. Along this travel path 28 there are located a closure device 29 and four band rolls or rollers 30, 31, 32 and 33. The start of the strapping band 20 is guided along the travel or orbiting path 28 by a mobile carriage or traveler 34 which places the strapping band 20 about the four band rolls or rollers 30 to 33 until the carriage 34 again reaches the closure device 29**.

This mobile carriage or traveler 34 can be coupled with and uncoupled from an endless belt or band member 35 or equivalent carriage drive structure. This endless belt 35 trains about four belt deflection rolls 36, 37, 38 and 39, each of which are located adjacent a related one of the band rolls 30 to 33. However, it is to be understood that it is not absolutely necessary that the belt deflection rolls 36, 37, 38 and 39 be coaxially arranged with respect to the band rolls 30 to 33. For the continuous drive of the belt 35 there is provided a belt drive 40 which is drivingly connected by means of a belt transmission or pulley drive system 41 with the first belt deflection roll 36.

An actuation magnet 42 is connected by means of transmission elements 43 with the band rolls or guide rollers 30 to 33, in order to pivot away these band rolls 30 to 33 out of the plane of the strapping band 20, so that the strapping band 20 can be released for strapping or tying the not particularly illustrated package which is located within the travel or motion path 28 of the strapping band 20. The transmission elements 43 can be constituted, for instance, by a lever system or cable pulley system.

Figure 3:
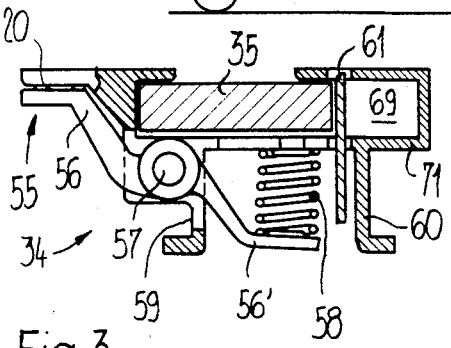
FIG. 3 is a cross-sectional view of the carriage or traveler, taken substantially along the section line III—III of FIG. 5, and which carriage serves for the transport of the ligature about the article or package to be strapped or tied.
Figure 4:
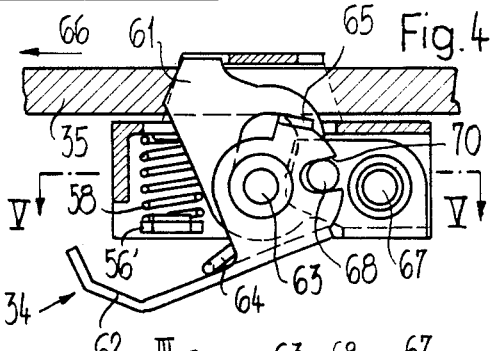
FIG. 4 is a side view of the carriage.
Figure 5:
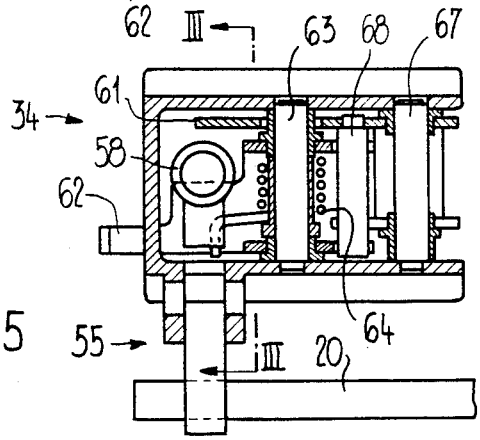
FIG. 5 illustrates the carriage of FIG. 4 in sectional view, taken substantially along the section line V—V of FIG. 4.

In order to actuate the closure device 29 there is provided a drive 44 by means of which a coupling and decoupling device, not particularly shown in FIG. 1 but illustrated in FIGS. 3 to 5, can be actuated, this coupling and decoupling device serving for selectively connecting and disconnecting the carriage 34 with and from the drive belt 35. Furthermore, the drive or drive means 44 also serves for actuating a band clamp 55 shown in FIG. 3, by means at which the carriage 34 seizes or grasps the strapping band 20 or the like.

A first switch 45 located at the region of the the closure position. A second switch 46 which is operatively connected with the transmission elements 43 serves for the time-delayed release or initiation of a further working or operating cycle. A third switch 47, operatively connected with the band storage or storage means 23, serves for reloading the band storage 23 by switching-on the band infeed drive 21.

Figure 2:
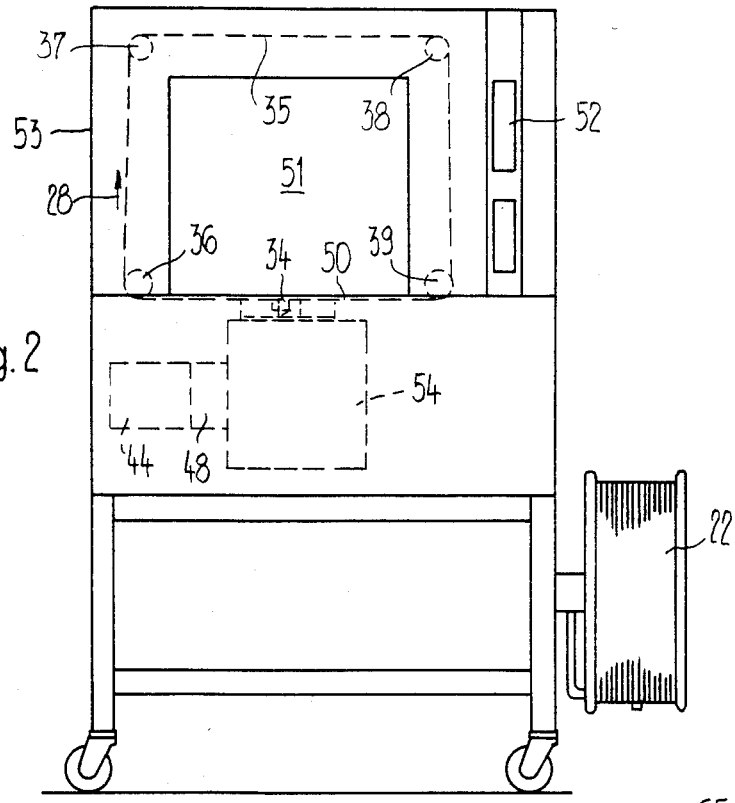
FIG. 2 is a front view of the strapping machine depicted in FIG. 1.

In FIG. 2 there is shown in front view the band strapping machine for binding packages or articles or the like, this machine operating according to the principles of the schematic illustration of the strapping machine depicted in FIG. 1. It will be particularly observed by inspecting FIG. 2 that the band strapping machine has a table surface or support 50 upon which there can be successively displaced through the package strapping tunnel 51 the not particularly illustrated packages or the like which are to be tied with the strapping band 20. In order to initiate the strapping or binding operation, there is provided either a push-button means upon a console 52 or a not particularly illustrated foot pedal or foot-operated switch.

The band supply roll 22 is located laterally of the package strapping machine for the easy exchangeability of such band supply roll 22. The strapping tunnel 51 is surrounded by a frame 53 which encloses the band travel or orbit path 28. The belt 35 and the belt deflection rolls 36 to 39 have been merely schematically depicted in FIG. 2 in order to symbolize the band travel path 28. Towards the center of the tunnel 51 the frame 53 possesses a not particularly here visible slot located at the strapping plane, in order to free the strapping band 20 for binding the packages. The rest position of the carriage or traveler 34 is located in the depicted closure position.

Beneath the table surface or support 50 there is located a strap wrapping and binding unit 54 and a band closure device 112 which fulfill the following functions:

uncoupling of the carriage or traveler 34 from the belt 35;

positioning of the carriage 34 in a predetermined position;

movement of the carriage 34 into a position for transfer of the strapping band which has been guided about the package;

movement of the carriage 34 into a second position for engaging the new strapping band-starting portion;

cutting of the strapping band;

closure or interconnection of both band ends of the strapping band which has been strapped or tied about the package;

coupling of the carriage 34 with the belt 35 for the next band strapping operation; and release of the strapping band which has been enclosed about the package.

In order to fulfill the previously mentioned functions, the strap wrapping and connection unit 54 is connected with the drive or drive means 44. The aforementioned functions will be explained in greater detail in conjunction with the following figures of the drawings.

FIGS. 3 to 5 illustrate in three different views the carriage or traveler 34 which is coupled with the belt 35. According to the showing of FIGS. 3 and 5 the starting portion of the strapping band 20 is clamped in a band clamp 55. The moveable jaw 56 of the band clamp 55 is mounted at a shaft 57 and at its opposite end 56' is pre-biased or loaded in the clamping direction by the action of a compression or pressure spring 58. At both sides the carriage 34 is equipped with guides or guide means 59 and 60 which serve for guiding the carriage 34 during positioning thereof into the strap wrapping and connection unit 54 illustrated in FIG. 2. A safety lever 61 is upwardly rocked or pivoted in the coupled position, in order to ensure the lateral position of the carriage 34 at the belt 35.

The arrangement of a release lever 62 will be apparent from the illustration of FIG. 4. This release lever 62 is pivotable about a shaft or pivot axis 63 and can be loaded by a spring 64 in the position where it is coupled with the belt 35. In order to couple or connect the carriage 34 with the belt 35 there is provided a clamping lever 65 connected with the release lever 62, this clamping lever 65 engaging from below at the belt 35 which travels in the direction of the arrow 66.

The safety or securing lever 61 is mounted upon a second transversely situated pivot shaft or axis 67. This safety or securing lever 61 is entrained by means of an entrainment bolt 68 by the release lever 62 and, specifically, in such a manner that it can rock or pivot in the counterclockwise direction about its pivot shaft or axis 67 according to the showing of FIG. 4, when the release lever 62 has been rocked by a suitable actuation element, such as the plunger or rod 76 shown in FIG. 7, in the clockwise direction. That means that the securing lever 61 is downwardly pivoted away from the belt 35 when the carriage 34 is decoupled from the belt or belt member 35. As a result, it is possible for the carriage 34, according to the showing of FIG. 3, to be moved by a certain amount towards the left with the belt 35 in motion, this movement towards the left corresponding approximately to the free space 69 located to the right thereof. In conjunction with other figures there will again be reverted to this free mobility of the carriage 34 in the uncoupled position thereof. The entrainment bolt 68 is rigidly connected with the safety or securing lever 61 and engages into a recess 70 of the release lever 62. The housing of the carriage 34 has been generally designated by reference character 71.

FIG. 5 shows the carriage 34 viewed approximately along a section V—V of the illustration of FIG. 4. Only the band clamp 55 and the therein clamped strapping band 20 are illustrated externally of the aforementioned section line.

The carriage 34 can be removed by actuating the release lever 62 as well as by pivoting it away from the belt 35. The mounting of the carriage 34 is accomplished by actuating the release lever 62 and by pivoting-in the carriage 34.

FIGS. 6 to 9 depict in different operating positions a device for the uncoupling and coupling of the carriage 34. This uncoupling and coupling device, hereinafter sometimes simply referred to as the coupling device, is a component of the strap wrapping and connection unit 54 depicted in FIG. 2. There will be again observed the previously discussed table surface or support 50, the driven belt 35 which revolves or orbits therebeneath and the carriage or traveler element 34.

Figure 6:
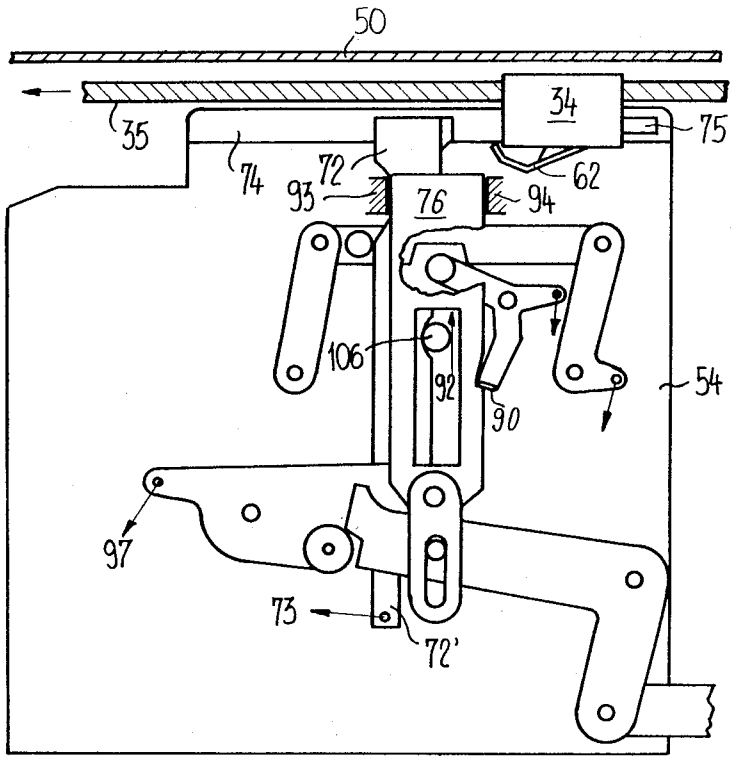
FIG. 6 illustrates a device for the uncoupling and coupling of the carriage in a position where the carriage is in the process of arriving thereat.

In the operating position depicted in FIG. 6 the carriage 34 coupled with the revolving belt 35 approaches a pivotable brake lever or lever member 72, defining a buffer device, which is pivotable about a suitable pivot axis or shaft which is not particularly visible in the showing of FIG. 6. The opposite end 72' of this brake lever 72 is pre-loaded or pre-biased by a spring in the direction of the arrow 73. The different elements of the uncoupling and coupling device depicted in FIG. 6 are located in the preparatory position for stopping and uncoupling the arriving carriage 34 from the belt 35 and which carriage has already traveled into a lateral guide rail 74 which engages into the right guide 60 of the carriage 34 shown in FIG. 3. The illustrated guide rail or rail member 74 is located opposite a not particularly illustrated guide rail of the same length, which engages into the left guide 59 of the carriage 34. Mounted at the illustrated guide rail 74 is a pawl or pawl member 75 over which just slides the carriage 34 as shown in FIG. 6. The release lever 62 of the carriage 34 is then still located in the belt-carriage coupling position.

Figure 7:
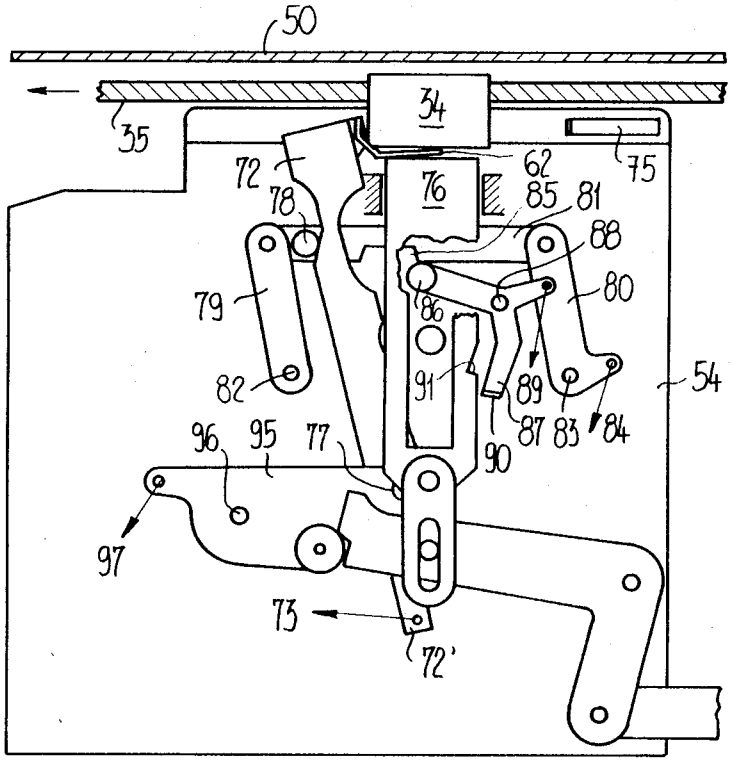
FIG. 7 illustrates the device of FIG. 6 with the carriage stopped.

According to the showing of FIG. 7, the carriage 34 is braked by the braking or brake lever 72, whereas the linearly guided uncoupling plunger or rod 76 is upwardly thrusted under the action of the force of a spring, and thus, has now actuated the release lever 62 of the carriage 34. As a result, the clamping lever 65 decouples the carriage 34 from the belt 35. This belt 35 now travels through the housing 71 of the carriage 34, as shown in FIG. 3, in an idle mode.

Due to the impact of the carriage 34 against the brake lever 72 the latter is pivoted in the counterclockwise direction about its pivot shaft or axis 77 against the spring force 73. Consequently, by means of an entrainment pin 78 a rod member 81, which is guided parallel to itself by means of two arm members 79 and 80, is moved towards the left. Both of the arms or arm members 79 and 80 are pivotable about stationary pivot shafts or axes 82 and 83. The right arm 80 is pre-biased in the clockwise direction by the force of a schematically represented spring 84 which engages thereat, so that the movement of the rod or rod member 81 towards the left is accomplished against the spring force.

A recess 85 provided in the rod 81 coacts with a pin 86 which is secured to one arm of a pawl lever 87. During the displacement of the rod 81 towards the left the pawl lever 87 is therefore rotated in counterclockwise direction about a stationary pivot shaft or axis 88 against the force of a spring 89 engaging thereat, since the pin or pin member 86 is displaced out of the recess 85. The rotational movement of the pawl lever 87 causes its pawl 90, which in its rest condition engages into a notch or recess 91 of the uncoupling plunger 76, to release this uncoupling plunger 76, which, in turn, is upwardly thrusted by the action of the force of a schematically represented spring 92 (FIG. 6) engaging thereat, in order to thereby actuate the release lever 62 of the carriage 34 for uncoupling the carriage 34 from the belt or belt member 35. The uncoupling or decoupling plunger 76 is guided by means of stationary guides or guide means 93 and 94 as well as by further not particularly illustrated guides. The brake or braking lever 72 is mounted at its pivot shaft 77 upon an intermediate lever or lever member 95 which is pivotable against the force of a spring 97 about a stationary pivot shaft or axis 96.

Figure 8:
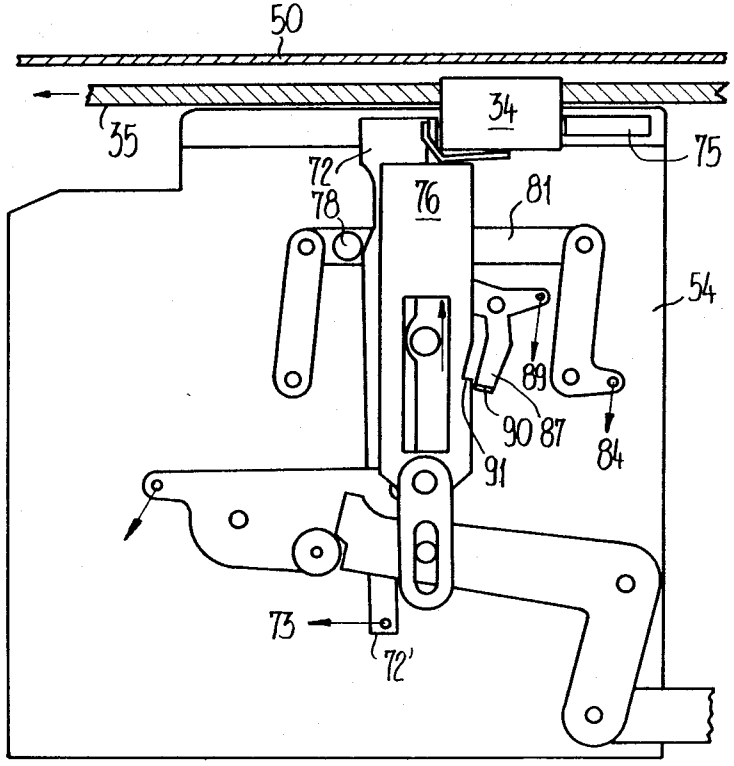
FIG. 8 illustrates the device of FIG. 6 with the carriage assuming a predetermined desired position.

According to the showing of FIG. 8 the carriage 34 which has been uncoupled from the belt 35 is displaced back, opposite to its travel direction, until reaching the pawl 75, due to the action of the force of the spring 73 by means of the brake lever 72. This brake lever 72 thus acts as a buffer or cushioning device in that it first stops the carriage 34 and after uncoupling of such carriage 34 pushes back such carriage. In this position the carriage 34 assumes an exactly defined position in relation to the strap wrapping and connection unit 54 for the transfer of the entrained strapping band 20 and for the seizing of the new starting band portion. During the return motion of the braking lever 72 such also follows the rod 81 under the action of the force of the schematically represented spring 84. Consequently, the pawl lever 87 is also released, as the same has been shown in FIGS. 6 and 7. This pawl lever 87 is again located in the preparatory position under the action of the force of the schematically represented spring 89, so that it can engage by means of its pawl 90 into the notch or recess 91 when the uncoupling plunger 76 has been retracted.

Figure 9:
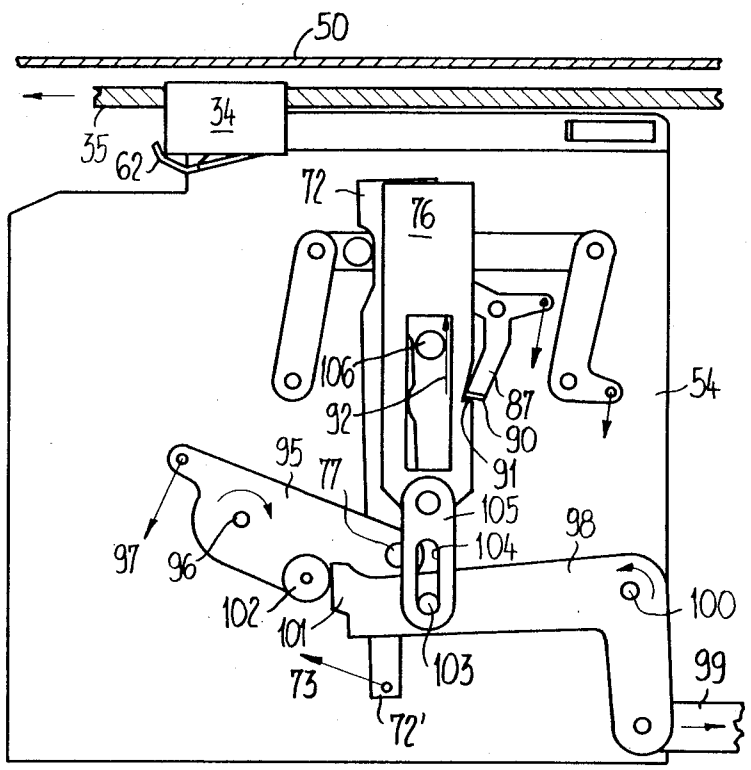
FIG. 9 illustrates the device of FIG. 6 in the coupling position.

FIG. 9 shows that operating position in which the carriage 34 has again just previously been coupled with the revolving or orbiting belt or belt member 35. For this purpose there is pivoted a return lever or lever member 98, due to the retraction of a rod or rod member 99, defining an actuation element, about a stationary pivot shaft 100 in the counterclockwise direction. The return lever 98 has pivoted, by means of its nose member 101 arranged at its end region, the intermediate lever or lever member 95 about its pivot shaft 96 in the clockwise direction, in that it has rolled its nose or nose member 101 upon a roll 102 arranged at this intermediate lever 95. Consequently, the brake lever 72, which is mounted by means of the shaft 77 at the intermediate lever 94, is retracted out of the travel path of the carriage 34. Only after the release of the travel path of the carriage 34 by the brake lever 72 does an entrainment pin 103 arranged at the return lever 98 come into contacting engagement with an elongate hole or slot 104 of a bracket member 105 which is hingedly connected with the parallel guided uncoupling or decoupling plunger 76, so that this uncoupling plunger 76 can be retracted by means of the bracket member 105 in order to release the release lever 62 of the carriage 34. Thereafter the self-locking clamping lever 65, according to the showing of FIG. 4, engages at the revolving belt 35. Now the belt-carriage coupling operation has been completed, so that the carriage or traveler 34 can again prepare a loop of the strapping band 20 at the travel path 28 according to the showing of FIGS. 1 and 2 for the purpose of binding or strapping the next following article or package.

When the rod 99 is pushed back opposite to the direction of the arrow, then there is established the position of the moveable parts or components depicted in FIG. 6. For returning the intermediate lever 95 there is employed the force of the schematically represented spring 97 engaging at its end. To return the brake or braking lever 72 against a stationary stop of abutment 106 there is employed, on the one hand, the pivoting of the intermediate lever 95 in the counterclockwise direction and, on the other hand, the force of the schematically indicated spring 73 engaging at the lever end 72'. The uncoupling or decoupling plunger 76 is only slightly displaced back in relation to the position depicted in FIG. 9 by the force of the schematically represented spring 92, until its notch or recess 91 bears against the pawl or pawl member 90. By releasing the release lever 62 at the carriage 34 the safety or securing lever 61, shown in FIGS. 3 and 4, is again rocked into the illustrated position, in order to ensure for the lateral positioning of the carriage 34 at the revolving belt 35.

In the position of the carriage 34 depicted in FIG. 8 there is accomplished a movement of the entire strap wrapping and connection unit 54 through a number of movement steps, in order to move the carriage 34 in each case into the appropriate positions for transfer of the encircled starting portion of the band 20. A complete work cycle only lasts for a fraction of a second, during which time all of the previously described functions are carried out. The actuation of the rod 99, according to the showing of FIG. 9, is accomplished by the drive 44 depicted in FIGS. 1 and 2 by means of cam disks or crank drives.

Figure 10:
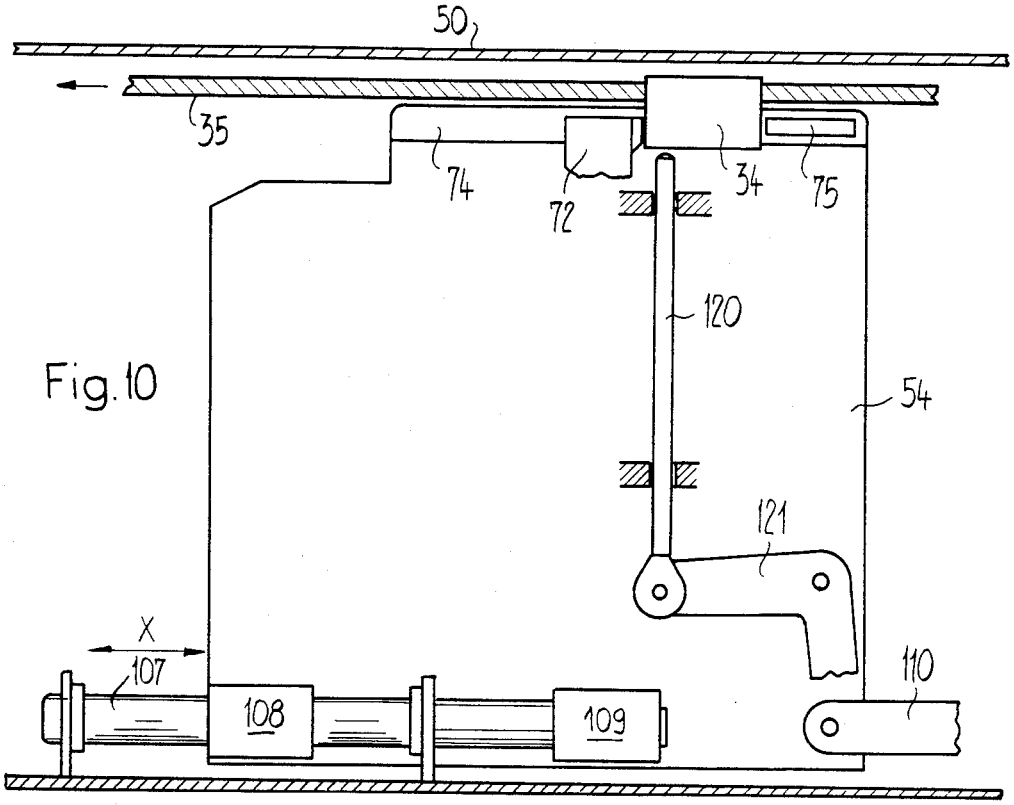
FIG. 10 illustrates a device for displacing the positioned carriage into the band transfer and band receiving position, depicting a plunger or rod for opening the band clamp of the carriage or traveler.

According to the showing of FIG. 10, the strap wrapping and connection unit 54 together with the carriage 34 which has been uncoupled from the belt 35 and properly positioned, is displaceably and pivotably mounted according to the showing of FIG. 8, in the direction of the X-axis upon a stationary round or circular rod 107 by means of the bearings 108 and 109. The displacement in the X-axis is accomplished likewise by the drive or drive means 44 depicted in FIGS. 1 and 2, by means of a displacement rod 110 which engages with such strap wrapping and connection unit 54. This displacement rod or rod member 110, just as the rod or rod member 99 of the showing of FIG. 9, is actuated by the cam disks or crank drive. A plunger 120 is actuatable by means of an angle lever 121 via the not particularly shown cam disk or the crank drive by means of the drive means 44 (FIGS. 1 and 2), in order to open the band clamp 55 of the carriage 34 (FIGS. 3 and 12) by engaging at the lever arm 56' of the clamping jaw 56.

Figure 11:
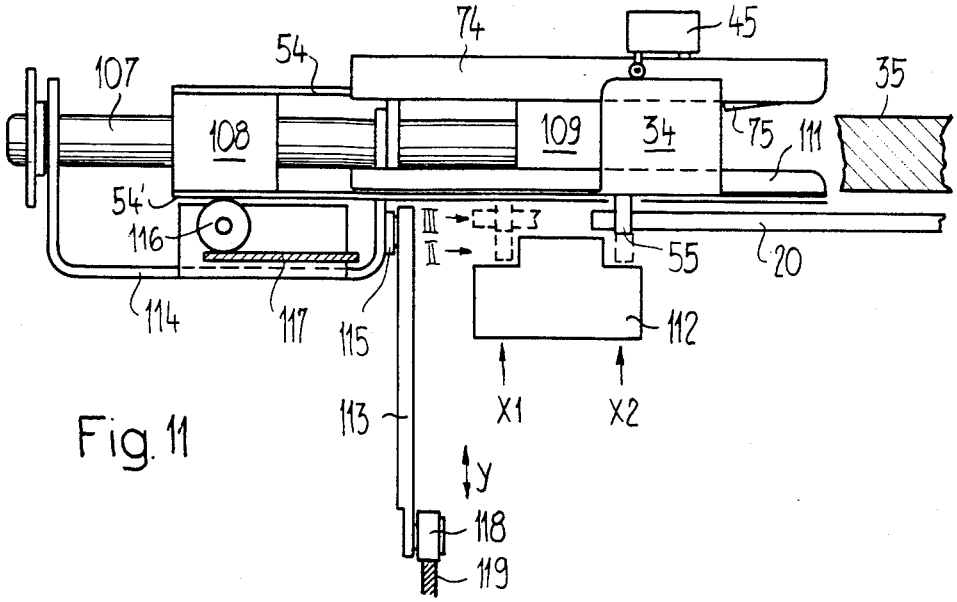
FIG. 11 illustrates a top plan view of the device shown in FIG. 10.

FIG. 11 is a top plan view of the arrangement of FIG. 10. The carriage or traveler 34 is laterally guided between the guide rail 74 and an oppositely situated guide rail 111 which engages into the guide 59 of FIG. 3. The belt or belt member 35 has only been schematically indicated, in order to portray the relative position of the strapping band 20 which has been drawn or pulled by the carriage 34.

Adjacent the path of travel of the carriage 34 there is arranged a band closure device 112 which fulfills the following tasks:

(1) Fixedly clamping the starting portion of the band 20 which has been guided throughout the travel or orbit path 28 according to FIGS. 1 and 2, after such starting portion of the band 20 has been transferred from the carriage 34 into the longitudinal position X1 of the closure device 112.

(2) Fixedly clamping of the band 20 after the band guided about the package has been tensioned by drawing back upon such band.

(3) Cutting-off of the band end which is looped about the package from the band supply after the new starting portion of the band has been seized in the lengthwise or longitudinal position X2 by the band clamp 55 of the carriage 34.

(4) Heating-up of the mutually confronting surfaces or interface of the overlapping band ends of the band looped about the package, by means of a suitable heating tongue or appropriate heating implement.

(5) Pressing together the overlapping band ends and cooling thereof.

(6) Release of the mutually interconnected band ends.

Such a band closure device 112 is well known in this technology. As far as the invention is concerned, it is only of significance that the carriage 34 together with its band clamp or clamp member 55 transfer the starting portion of the looped band in the first lengthwise or longitudinal position X1 and engages the new band starting portion in the second lengthwise or longitudinal position X2. To this end the carriage 34 must not only be moved in the lengthwise direction X, but also in the transverse direction Y. For perfecting the longitudinal or lengthwise motion the strap wrapping and connection unit 54 is displaceable upon the rod or rod member 107 by means of the displacement rod 110. The movement in the transverse direction Y is accomplished by pivoting the strap wrapping and connection unit 54 about the guide rod 107 by means of a pivot rod 113 which engages at a bracket 114 by means of a joint or hinge connection 115. From the bracket or bracket member 114 there is accomplished the transmission of the pivotal movement to the strap wrapping and connection unit 54 by means of a roll or roller 116 which is rotatably mounted at the bracket 114, and which roller engages, on the one hand, against the surface 54' of the strap wrapping and connection unit 54 and, on the other hand, engages at a metal plate guide 117 connected with the strap wrapping and connection unit 54. The pivotal rod or rod member 113 possesses at its one end a follower roll or follower 118 which rolls upon the only schematically illustrated cam disk 119 which is connected with the drive or drive means 44 illustrated in FIGS. 1 and 2. The first switch 45 (FIG. 1) signals or indicates the presence of the carriage 34 in the closure position.

Figure 12:
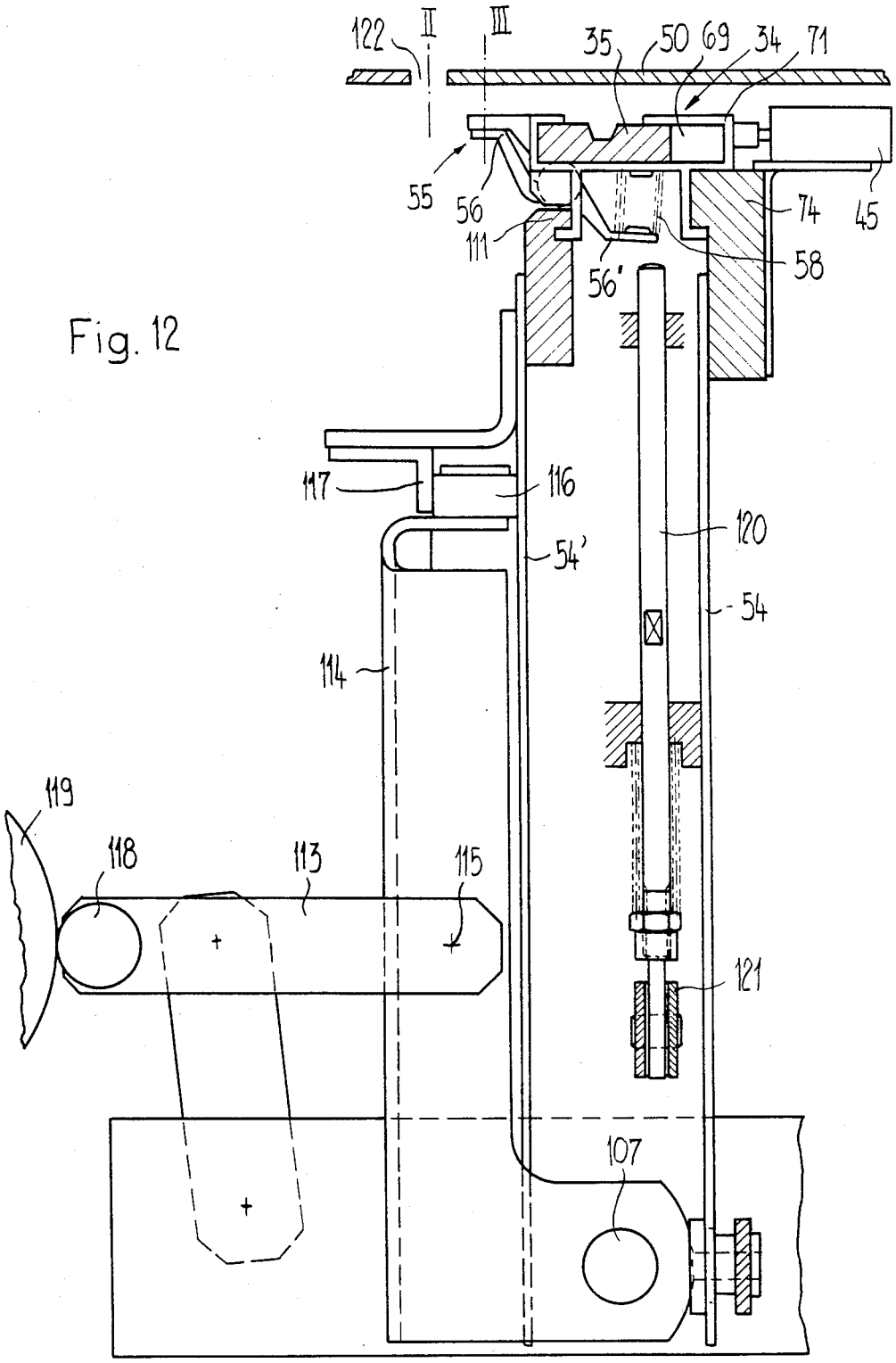
FIG. 12 illustrates the device shown in FIG. 10 in an end view.

FIG. 12 illustrates the device according to FIGS. 10 and 11 in an enlarged scale and in side view. The table surface or support 50 is interrupted by a slot 122 which not only extends over the table surface 50 but also over the entire frame 53 shown in FIG. 2, in order to transfer the strapping band 20 from the travel or orbit path 28 to the package which is to be bound or tied with such strapping band 20. The slot 122 surrounds the strapping tunnel 51 in the closure plane II. Reference character III designates the carry plane in which the carriage 34 guides the strapping band 20 along the orbit or travel path (FIGS. 1 and 2).

Figure 13:
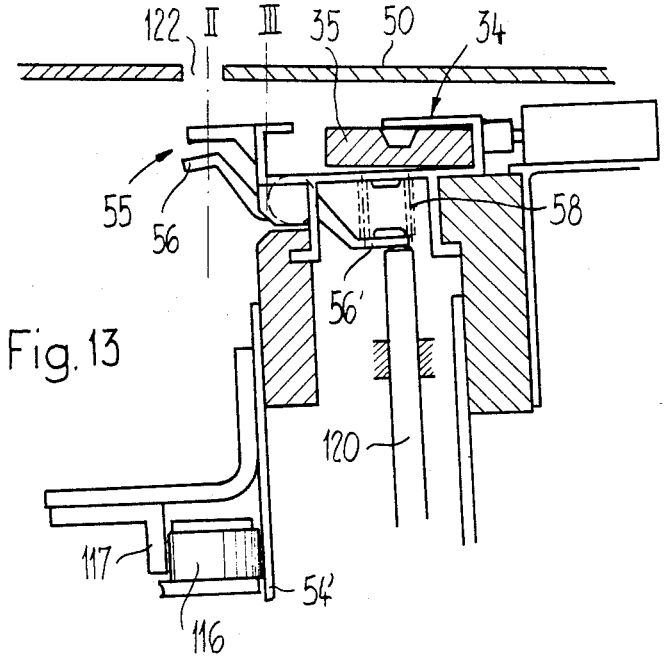
FIG. 13 illustrates the device of FIG. 10 in a position pivoted in relation to the showing of FIG. 12.

In the showing of FIG. 13 there has been depicted the strap wrapping and connection unit 54 together with the positioned carriage 34 pivoted into the closure plane II. The actuation is accomplished by means of the pivot rod 113 (FIGS. 11 and 12). The band clamp 55 is opened by actuating the plunger 120 against the force of the spring 58, in order to transfer the band to the band closure device 112 at the lengthwise position X1 (FIG.

11) and in order to seize the new starting band portion in the lengthwise position X2. Notwithstanding the pivoting of the carriage 34 the traveling belt 35 remains in its plane, for which purpose there is provided the free space 69 in the carriage 34 (FIG. 3).

Figure 14:
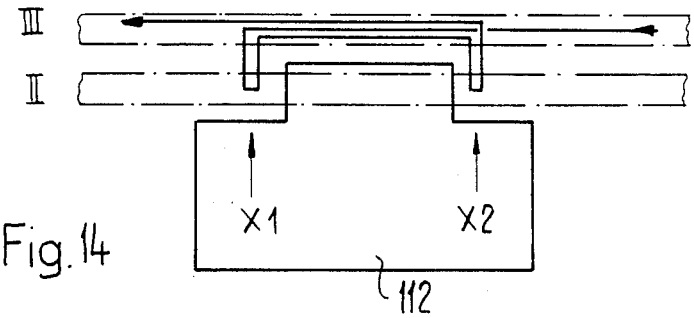
FIG. 14 is a schematic view depicting the carriage movements for transfer or delivery of the band starting portion after the strapping or wrapping of the band about the article and for taking-up a new band starting portion.

FIG. 14 schematically illustrates the movements of the carriage 34 positioned in the strap wrapping and connection unit 54 in relation to the closure device 112. After the carriage 34 has been positioned as shown in FIG. 8, it is located at the cross-over or intersection point X2/III. The thereafter following movement by means of the strap wrapping and closure unit 54 initially guides the carriage 34 to the intersection point X1/III and thereafter to the intersection point X1/II, in order to transfer the band starting portion to the band closure device 112. Finally, there is accomplished the return to the intersection point X2/III, from which the carriage 34 starts for performing a renewed orbiting thereof according to the showing of FIG. 9. During the movement of the carriage 34 its band clamp 55 is opened at the intersection point X1/II and is again closed at the intersection point X2/II.

Figure 15:
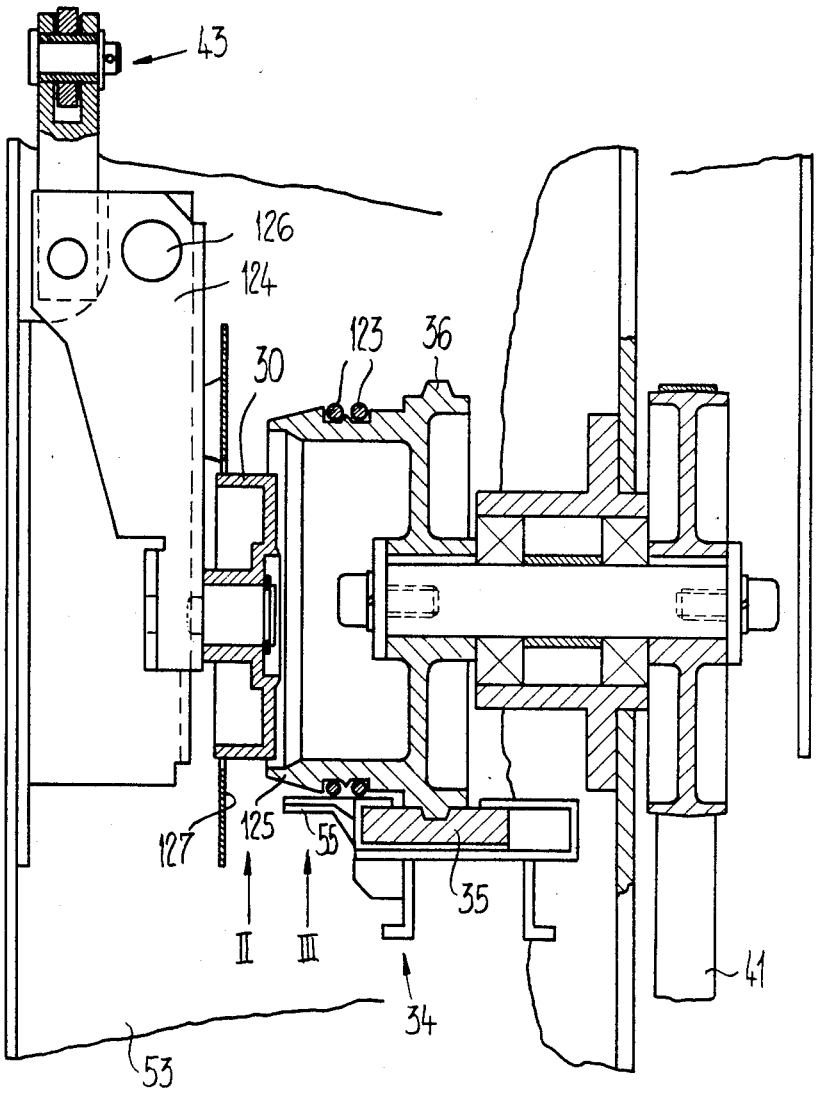
FIG. 15 illustrates an ejection or throw-off device for the encircling band at the package.

FIG. 15 shows one of the four throw or ejection devices with the belt deflection roll 36 and the band roll 30 which is mounted to be freely rotatable at least approximately coaxially thereto at a pivot lever 124 in the closure plane II. By means of the belt transmission 41 the deflection roll 36 and therefore the belt 35 is driven by the belt drive 40 (FIG. 1). The carriage 34 which is coupled with the belt 35 just passes the deflection roll 36 which is equipped with an inserted rubber ring member 123 for guiding the carriage 34. This carriage 34 guides the band 20 by means of its band clamp or clamp member 55 in the carry or entrainment plane III of the orbit or motion path 28 (FIG. 2). After it has passed the deflection roll 36 the band 20 retained under tension by the band storage 23 (FIG. 1) arrives by means of a conical surface 125 arranged at the deflection roll 36 at the band roll 30. The pivot lever 124 which is pivotable about a stationary pivot shaft 126 is pivotable out of the closure plane II by means of the transmission elements 43 due to the actuation magnets 42 simultaneous with the pivot levers of all four band rolls 30 to 33 (FIG. 1), in order to throw the band 20 onto the article or package which is to be wrapped. Stationary sheet metal strippers or stripper elements 127 ensure for a positive throw-off of the band. The freely rotatable band rolls 30 to 33 provide a low frictional resistance during encirclement of the band 20, so that the carriage 34 only must overcome a relatively small tension force. A not too small selected radius of the band rolls 30 to 33 prevents too pronounced bending of the band 20, something which could be disadvantageous during longer standstill times.

Figure 16:
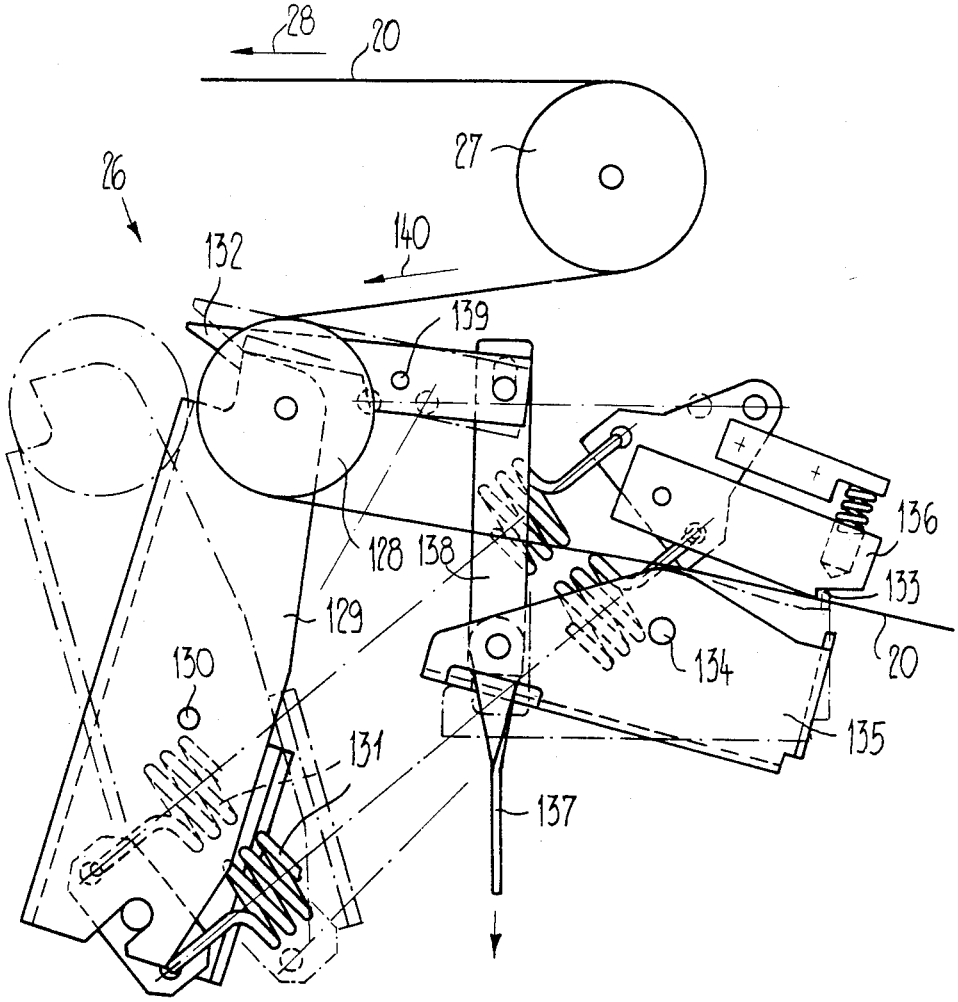
FIG. 16 illustrates a tensioning device for the strapping band.

The force tensioning device 26 shown in FIG. 1 and illustrated in greater detail in FIG. 16 serves to tension the strapping band 20 which has been placed about the package after such band 20 has been already pulled back by the band storage 23 with a smaller tensioning force to remove its slack. The band 20 trains about a freely rotatable tensioning roll or roller 128 which is mounted at a tensioning lever 129. The tensioning lever 129 which is pivotable about a stationary pivot point 130 is retained by a release pawl or pawl member 132 in the tensioned position against the force of two stationary, stressed and parallel arranged springs 131. The strapping band 20 passes through a band clamping point or nip 133 which is formed by a band clamping lever 135 pivotable about a stationary pivot axis or shaft 134 and by a resilient counterstop 136. By means of the deflection roll 27 the band 20 arrives at the orbit or travel path 28. At the band clamping lever 135 there engages a traction rod 137 which is connected by means of the coupling 48 (FIGS. 1 and 2) with the drive or drive means 44. Merging with the traction rod 137 is a bracket member 138 which is hingedly connected with the release pawl 132 which is pivotable about a stationary pivot point 139.

To activate the force tensioning device 26, after the strapping band 20 has been thrown onto the package and pulled back through the force tensioning device 26 by the band storage 23, the traction or tension rod 137 is actuated in the direction of the arrow by means of not particularly depicted connection elements and by means of the drive 44 (FIG. 1). Consequently, the band clamping lever 135 initially engages at the clamping point 133 at the band 20 in order to retain the latter. During further motion of the traction rod 137 the release pawl 132 releases the tensioning lever 129 which is then pivoted by both of the tensioning springs 131 in the counterclockwise direction. Hence, there is exerted upon the strapping band 20 a tensioning force in the direction of the arrow 140, and which tensioning force can be chosen within wide limits by the tensioning springs 131. In any event such tensioning force is greater than the return or pull-back force of the storage 23. The stepwise function, namely first clamping and then tensioning, assures for a great reliability with always the same tensioning force.

Since during each work or operating cycle only the small mass of the carriage 34 must be accelerated, the drive motor for the drive of the belt 35 can be smaller than in the case of a package strapping machine in which each time all of the revolving parts must be accelerated. The overlapping of the successive work cycles, namely carrying around the band for the next cycle during the connection (welding or fusion) of the band ends, assures for the largest possible operating speeds.

While there are shown and described present preferred embodiments of the invention, it is to be distinctly understood that the invention is not limited thereto, but may be otherwise variously embodied and practiced within the scope of the following claims. Accordingly,

What I claim is:

1. A machine for strapping packages with a ligature in the form of a strapping band having a band starting portion, comprising:

a strapping tunnel for receiving the package which is to be tied with the strapping band;

an endless belt movable around said package along a predetermined path;

means for continuously moving said belt around the package;

a carriage supported by said endless belt when engaged therewith, a strapping band clamp mounted on said carriage to clamp the band starting portion;

the carriage being moveable along said predetermined path of travel in order to guide the band starting portion around the package for forming a band loop;

a strapping band-supply roll for supplying the strapping band;

band holder means moveable so as to protrude into a plane containing the band loop and moveable out of said plane in order to selectively hold the band loop and to release the same so as to encircle the package;

intermediate storge means containing a return storage capacity for taking-up band slack arranged between the strapping band-supply roll and the path of travel;

a clamping device for fixedly retaining the ends of the strapping band which has been laid about the package;

a releasable coupling device for uncoupling the carriage from the continuously revolving belt;

an actuation device for actuating the releasable coupling device;

a closing device for the strapping band to interconnect the ends of the strap;

said actuation device being arranged at the region of the clamping and closing devices; and a positioning device for driving and positioning the uncoupled carriage in adjacent to the clamping and closing device.

2. The machine as defined in claim 1, wherein:

said releasable coupling device for the carriage comprises an externally actuatable release lever; and a self-locking clamping lever engaging at the belt and with which there is operatively connected the release lever.

3. The machine as defined in claim 1, wherein:

said actuation device for uncoupling the carriage from the belt comprises a spring-loaded uncoupling and coupling element;

a first locking pawl for holding back said uncoupling and coupling element;

a buffer device protruding into the path of travel of the carriage and moveable out of such path of travel; and said buffer device being connectable with the locking pawl in order to activate the uncoupling and coupling element for performing an uncoupling operation.

4. The machine as defined in claim 3, further including:

a second locking pawl located opposite said buffer device and over which there can travel the carriage; and said buffer device together with said oppositely situated second locking pawl forming part of said positioning device.

5. The machine as defined in claim 4, wherein:

said positioning device comprises at least a guide rail for the lateral guiding of the carriage.

6. The machine as defined in claim 3, further including:

an actuation element with which there is operatively connected the buffer device for the program-controlled retraction thereof out of the path of travel of the carriage and with which there is operatively connected the actuation device for its retraction from the carriage for coupling thereof with the belt.

7. The machine as defined in claim 1, wherein:

said positioning device is moveably arranged; and actuation elements with which there is connected said positioning device for the program-controlled movement of the carriage when located in a predetermined position into a strapping band-transfer position and a strapping band-receiving position.

8. The machine as defined in claim 7, wherein:

a carry plane for the strapping band and defined by a strapping band clamp of the carriage;

said carry plane being substantially parallelly shifted in relation to a closure plane defined by the clamping and closure devices;

said strapping band-transfer position and said strapping band-receiving position being located in the closure plane; and said positioning device being arranged to be moveable both in a lengthwise direction substantially parallel to said closure plane and said carry plane and also in a transverse direction relative thereto, in order to move the carriage with said strapping band clamp from the carry plane into the closure plane and back again into the carry plane.

9. The machine as defined in claim 7, wherein:

said actuation elements comprise cam disk means;

a motor drive means; and said cam disk means being connectable with said motor drive means.

10. The machine as defined in claim 1, wherein:

said actuation device intended for the actuation of the releasable coupling device of the carriage and said positioning device are assembled together to form a unit; and said unit comprising a program-controlled plunger for opening the strapping band clamp of the carriage.

11. The machine as defined in claim 6, wherein said actuation elements with which there is connected the positioning device comprise cam disk means;

a motor drive means;

said cam disk means being connectable with said drive means;

said actuation device intended for the actuation of the releasable coupling device of the carriage and said positioning device being assembled together to form a unit;

said unit comprising a program-controlled plunger for opening the strapping band clamp of the carriage;

a plunger for opening said strapping band clamp; and the motor drive means possessing a coupling for the program-controlled actuation of the positioning device, the uncoupling and coupling element for the carriage and the plunger for opening the strapping band clamp.

12. The machine as defined in claim 11, further including:

a force tensioning device connected in driving relationship with the motor drive means;

said force tensioning device being arranged between the intermediate storage means and a predetermined travel path of the strapping band;

said force tensioning device possessing means defining a clamping point for retaining the strapping band during a band tensioning operation;

a spring-loaded tensioning roll arranged following the force tensioning device;

said spring-loaded tensioning roll being at least partially entrained by the strapping band;

a band clamping lever for defining the clamping point;

a further locking pawl for retaining the tensioning roll in a band tensioning position; and said band clamping lever and said further locking pawl being arranged to be successively actuated by a tensioning device-actuation element which is program-controlled from the motor drive means.

13. The machine as defined in claim 8, wherein:

said holder means arranged about the strapping tunnel and in distributive relationship in the closure plane comprises freely rotatable band rolls.

14. The machine as defined in claim 13, wherein:

the closure plane constitutes a band loop plane defined by the position of the clamping and closure devices and which is shifted substantially parallelly in relation to the band carry plane defined by the strapping band clamp of the carriage;

the band carry plane being defined by an arrangement of belt deflection rolls about which there is trained the belt;

said band holder means comprising a plurality of band rolls; and each said belt deflection roll being arranged at least approximately coaxial to a related band roll.

15. The machine as defined in claim 14, wherein:

said belt deflection rolls possess substantially conical surfaces confronting the band rolls; and said band rolls having a diameter which is smaller than the smallest diameter of the conical surface.

* * * * *

UNITED STATES PATENT AND TRADEMARK OFFICE

CERTIFICATE OF CORRECTION

PATENT NO. : 4,554,779

DATED : November 26, 1985

INVENTOR(S) : CHARLES FISCHER

It is certified that error appears in the above—identified patent and that said Letters Patent is hereby corrected as shown below:

In the Abstract, line 5, please delete "revolting" and insert --revolving--

Signed and Sealed this

*Fourth* Day of *March 1986*

[SEAL]

*Attest:*

DONALD J. QUIGG

*Attesting Officer*

*Commissioner of Patents and Trademarks*